US007837573B1

(12) United States Patent
Bullock

(10) Patent No.: US 7,837,573 B1
(45) Date of Patent: Nov. 23, 2010

(54) GOLF PUTTING TRAINING DEVICE

(76) Inventor: David C. Bullock, 1620 River Loop One, Eugene, OR (US) 97404

( * ) Notice: Subject to any disclaimer, the term of this patent is extended or adjusted under 35 U.S.C. 154(b) by 0 days.

(21) Appl. No.: 12/456,679

(22) Filed: Jun. 19, 2009

(51) Int. Cl.
*A63B 69/36* (2006.01)

(52) U.S. Cl. ..... 473/174; 473/164

(58) Field of Classification Search ..... 473/173, 473/174, 179–189
See application file for complete search history.

(56) References Cited

U.S. PATENT DOCUMENTS 1,656,740 A * 1/1928 Kurtz ..... 473/185
1,738,265 A * 12/1929 Scanlan ..... 273/123 R
2,635,879 A * 4/1953 Rath ..... 473/180
3,048,405 A * 8/1962 McCaul ..... 473/180
3,065,971 A * 11/1962 Coles ..... 473/182
3,512,262 A * 5/1970 Smyk et al. ..... 33/555.2
5,100,147 A 3/1992 Mull
5,282,626 A * 2/1994 Millar ..... 473/174
5,407,203 A * 4/1995 Jones ..... 473/195
5,478,071 A * 12/1995 Barrs et al. ..... 473/176
2002/0045488 A1 * 4/2002 Patterson ..... 473/180
2005/0032580 A1 * 2/2005 Rango ..... 473/164
2008/0132348 A1 * 6/2008 Prince ..... 473/174

* cited by examiner

*Primary Examiner*—Mark S Graham
(74) *Attorney, Agent, or Firm*—Robert E. Howard

(57) ABSTRACT

A golf putting training device including a circular target having a substantially flat body having substantially parallel upper and lower surfaces. A bumper formed of rubber or an elastomeric polymer is attached to or integral with the peripheral edge of the target. The upper surface of the target has a plurality of substantially equally spaced-apart primary lines extending from the center to the peripheral edge to form a lane between each adjacent pair of primary lines. The width of each lane is substantially the width of a regulation hole. The circular target can be divided into partially circular targets having a 90 degree, 180 degree, or 270 degree circumference.

8 Claims, 2 Drawing Sheets

GOLF PUTTING TRAINING DEVICE

BACKGROUND OF THE INVENTION

The present invention relates to a golf putting training device that can be used upon any indoor or outdoor surface upon which a golf ball will roll, and can be easily stored and transported.

Putting can account for about half the strokes of a round of golf played by a competent player. For example, on a par four hole a good golfer can be on the green in two or three strokes, but can end up adding two or three more strokes in putting the ball into the hole. Even for a player with more modest skills accurate putting can significantly reduce the number of strokes generated in an eighteen hole round of golf.

Many devices have been suggested for allowing a golfer to practice putting at home or work. The simplest such device is a glass or plastic tumbler placed on its side on the floor with its open end facing the putter. Other common devices use a target having a surface positioned aperture approximating the size of a regulation hole. In both of these types of devices the ball must be retrieved after putting.

Another type of training device uses a target from which the putted ball rebounds if struck. Many of these devices do not provide feedback to the putter as to the accuracy of the putt, or they require the use of a putting mat in addition to the target device.

SUMMARY OF THE INVENTION

The golf putting training device of the present invention is simple to construct, and easy to store and transport. It provides immediate feedback on the accuracy of a putt, and accurate putts are rewarded by returning the ball to the spot where the putt originated.

The golf putting training device includes a circular target having a substantially flat body having substantially parallel upper and lower surfaces. A bumper formed of rubber or an elastomeric polymer is attached to or integral with the peripheral edge of the target. The upper surface of the target has a plurality of substantially equally spaced-apart primary lines extending from the center to the peripheral edge to form a lane between each adjacent pair of primary lines. The width of each lane is substantially the width of a regulation hole. The circular target can be divided into partially circular targets having a 90 degree, 180 degree, or 270 degree circumference.

DESCRIPTION OF PREFERRED EMBODIMENTS

Figure 1:
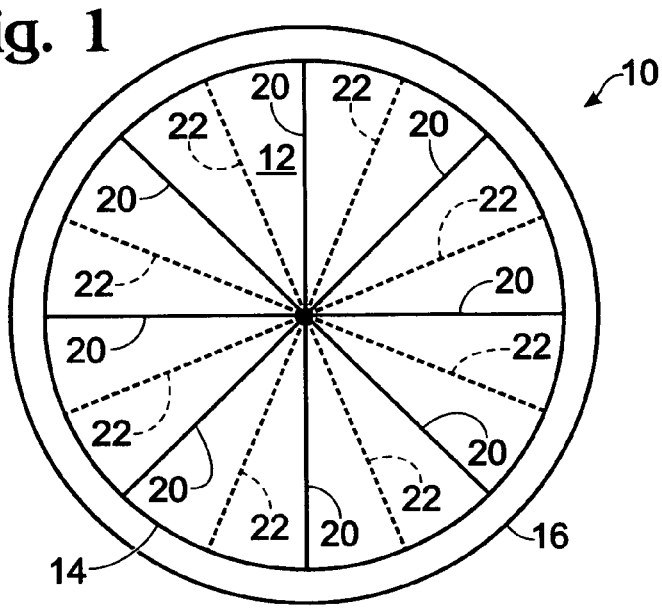
FIG. 1 is a top plan view of the 360 degree circular configuration of the putting trainer of the present invention.

The putting trainer 10 of the present invention has a circular body 12 having a peripheral edge 14. The thickness of circular body 12 is preferably substantially equal to the diameter of a regulation golf ball, i.e., about 1.68 inches.

A bumper 16 is attached to the peripheral edge 14. Bumper 16 is formed of rubber or a synthetic elastomeric polymer that, like rubber, resumes its original shape when a deforming force is removed. The cross-sectional shape of bumper 16 preferably is triangular-like, similar to the bumper of a pool table. However, other cross-sectional shapes may be used, such as semi-circular or rectangular.

A plurality of primary lines 20 extend outwardly from the center of circular body 12 to the peripheral edge 14. The space between adjacent primary lines 20 at their intersection with peripheral edge 14 forms a lane which is substantially the width of a regulation golf hole, i.e., about 4.25 inches.

A plurality of secondary lines 22 extend outwardly from the center of circular body 12 to the peripheral edge 14, and are located mid-way between adjacent primary lines 20. The secondary lines 22 are shown as broken lines in the drawings to distinguish them from the primary lines 20. However, any way of distinguishing the secondary lines 22 from primary lines 20 may be used, such as a difference in color, line thickness, etc.

In use, putting trainer 10 is placed on a surface 30 over which a golf ball 40 can roll, such as a carpeted floor or an outdoor surface such as a putting green. With its 360 degree circular configuration putting trainer 10 can be used by multiple users positioned at locations around the trainer. Each putter selects a distance from the center of the putting trainer 10 which he desires to practice.

If the putter wishes to practice a putt where the green is relatively flat, a lane directly in front of the putter would be selected as the target lane and the ball putted towards that lane. The putter can immediately see if the ball hits the center of the lane at which he/she was aiming, indicating that the ball would be heading directly for the hole. When the ball hits the bumper 16 it rebounds back towards the putter.

If the putter wishes to practice a shot he/she might encounter where the green slopes, he can aim at a spot on the peripheral edge 14 representing the desired amount of break, and upon the ball striking bumper 16 the putter immediately knows if he/she successfully hit the chosen spot.

Figure 2:
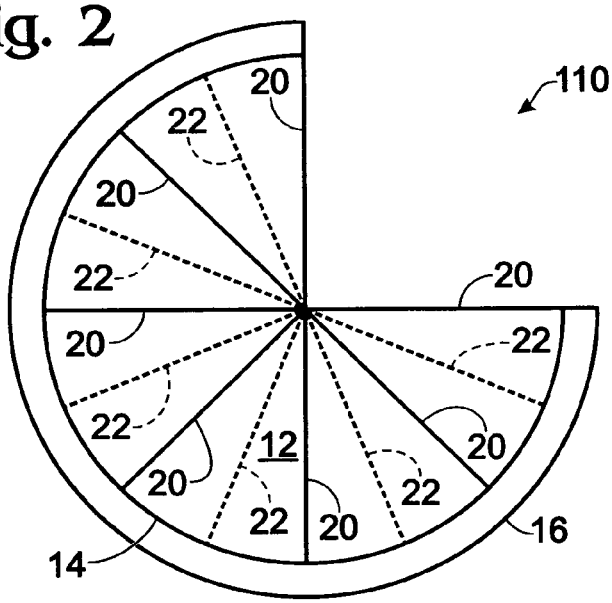
FIG. 2 is a top plan view of the 270 degree three-quarter circular configuration of the putting trainer of the present invention that can be placed at the juncture of two walls.

Putting trainer 10 is constructed to allow the user to remove one-quarter thereof with the remainder forming a three-quarter circular putting trainer 110, as shown in FIG. 2. The three-quarter circular configuration of FIG. 2 allows the putting trainer 110 to be placed at the intersection of two walls.

Figure 3:
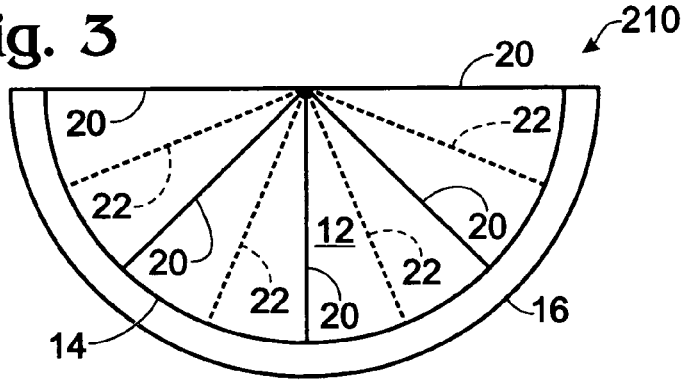
FIG. 3 is a top plan view of the 180 degree semi-circular configuration of the putting trainer of the present invention that can be placed against a wall.

Putting trainer 10 is also constructed to allow the user to remove one-half thereof to form a semi-circular putting trainer 210, as shown in FIG. 3. The semi-circular configuration of FIG. 3 allows the putting trainer 210 to be placed against a wall.

Figure 4:
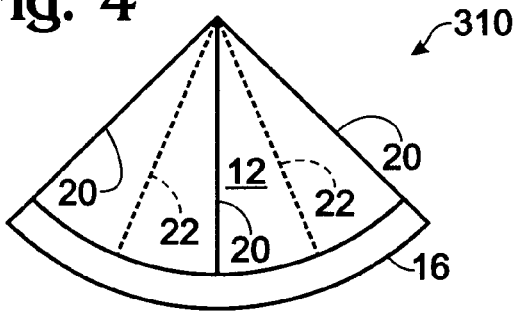
FIG. 4 is a top plan view of the 90 degree one-quarter circular configuration of the putting trainer of the present invention that can be placed at the convergence of two walls.
Figure 5:
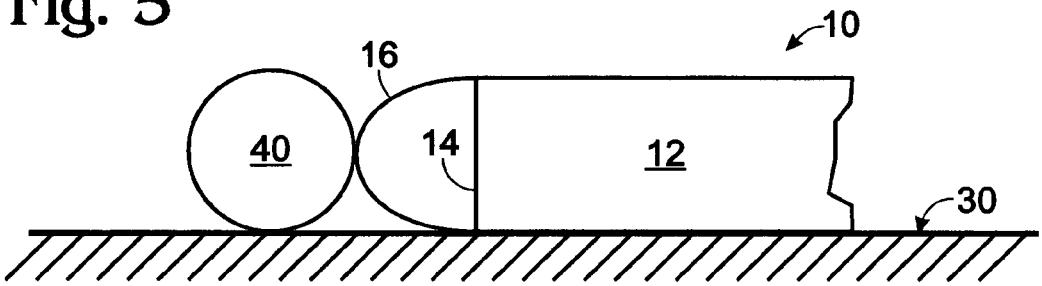
FIG. 5 is an elevation view of the peripheral edge of the putting trainer of the present invention.

Finally, putting trainer 10 is constructed to allow the user to remove one-quarter thereof to form a one-quarter circular putting trainer 310, as shown in FIG. 4. Such a configuration can be placed anywhere, and is designed to be used by a single person.

Figure 6:
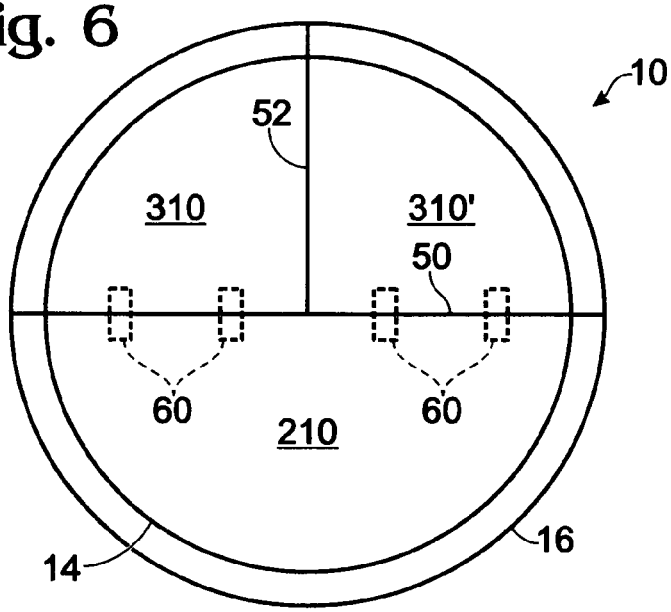
FIG. 6 is a bottom plan view of the 360 degree circular configuration of the putting trainer of the present invention showing the junctures of the various configurations being held in place by releasable attachment means.

As best seen in FIG. 6, target portions 310 and 310' are removably attached to target portion 210 along juncture 50 by any suitable means, such as dowel pins 60, or magnets (not shown), and target portions 310 and 310' abut along juncture 52. The 180 degree configuration target 210 is formed from 360 degree target 10 by removing the two 90 degree targets

310, 310'. The 270 degree target 110 is formed from 360 degree target 10 by removing one 90 degree target 310 or 310'. The 90 degree target 310 (or 310') is formed from 360 degree target 10 by removing it from target portion 210.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A golf putting training device comprising:

a circular target including a substantially flat body with a peripheral edge, said flat body having upper and lower planar surfaces that are substantially parallel to each other;

a bumper attached to or integral with said peripheral edge; and a plurality of substantially equally spaced-apart primary lines extending from the center of said body to said peripheral edge and forming a lane between each adjacent pair of primary lines, the distance between each of said pairs of adjacent primary lines at their intersection with said peripheral edge being substantially equal to the diameter of a hole on a golf green.

2. The device of claim 1 wherein said flat body has a thickness that is substantially equal to the diameter of a golf ball.

3. The device of claim 2 wherein said flat body has a thickness that is substantially 1.68 inches.

4. The device of claim 1 wherein the distance between each of said pair of adjacent primary lines at their intersection with said peripheral edge is substantially 4.25 inches.

5. The device of claim 1 including a plurality of secondary lines substantially equally spaced-apart and extending from the center of said body to said peripheral edge, one such secondary line being located between each of said pairs of adjacent primary lines substantially at the mid-portion thereof.

6. The device of claim 1 wherein said flat body of said circular target has releasable attachment means along a diameter thereof adapted to allow the circular target to be divided into two semi-circular targets.

7. The device of claim 6 wherein at least one of said two semi-circular targets has releasable attachment means along the ninety degree radius thereof adapted to allow the semi-circular target to be divided into two quarter-circular targets.

8. The device of claim 1 wherein said bumper is formed of rubber or a synthetic elastomeric polymer.

* * * * *